US006572047B1

(12) United States Patent
Ghiardo

(10) Patent No.: US 6,572,047 B1
(45) Date of Patent: Jun. 3, 2003

(54) YARN BRAKE AND YARN FEEDING DEVICE HAVING A YARN BRAKE

(75) Inventor: Fiorenzo Ghiardo, Pettinengo (IT)

(73) Assignee: Iropa AG, Baar (CH)

( * ) Notice: Subject to any disclaimer, the term of this patent is extended or adjusted under 35 U.S.C. 154(b) by 0 days.

(21) Appl. No.: 09/806,788

(22) PCT Filed: Oct. 5, 1999

(86) PCT No.: PCT/EP99/07409

§ 371 (c)(1),
(2), (4) Date: Jun. 15, 2001

(87) PCT Pub. No.: WO00/20316

PCT Pub. Date: Apr. 13, 2000

(30) Foreign Application Priority Data

Oct. 7, 1998 (DE) ..... 198 46 221

(51) Int. Cl.[7] ..... B65H 51/20; B65H 23/16; D03D 47/36

(52) U.S. Cl. ..... 242/365.4; 139/452; 242/128; 242/419.4

(58) Field of Search ..... 242/365.4, 364, 242/128, 419.4; 139/452

(56) References Cited

U.S. PATENT DOCUMENTS

| | | | | | |
|---|---|---|---|---|---|
| 4,429,723 | A | * | 2/1984 | Maroino | 242/365.4 |
| 5,343,899 | A | * | 9/1994 | Jacobsson et al. | 242/365.4 |
| 5,546,994 | A | * | 8/1996 | Sarfati | 242/365.4 |
| 5,577,536 | A | * | 11/1996 | Maina | 242/365.4 |
| 5,647,404 | A | * | 7/1997 | Maina et al. | 139/452 |
| 5,673,729 | A | * | 10/1997 | Maina et al. | 139/452 |
| 5,678,779 | A | | 10/1997 | Maina | |
| 5,738,291 | A | | 4/1998 | Tholander | |
| 6,125,892 | A | * | 10/2000 | Fritzson | 242/365.4 |
| 6,164,580 | A | * | 12/2000 | Tholander et al. | 242/365.4 |
| 6,269,843 | B1 | * | 8/2001 | Bertolone | 242/365.4 |
| 6,322,016 | B1 | * | 11/2001 | Jacobsson et al. | 242/365.4 |

FOREIGN PATENT DOCUMENTS

| | | | |
|---|---|---|---|
| DE | 94 06 102 U1 | | 8/1995 |
| DE | 44 07 958 | | 9/1995 |
| EP | 0 049 897 | | 4/1982 |
| EP | 0 330 951 | | 9/1989 |
| WO | WO 98/23520 | * | 6/1998 |
| WO | WO 99/64337 | | 12/1999 |

* cited by examiner

*Primary Examiner*—Michael R. Mansen
(74) *Attorney, Agent, or Firm*—Flynn, Thiel, Boutell & Tanis, P.C.

(57) ABSTRACT

A ring-shaped, thin walled braking body with a circumferentially continuous and conical braking surface in a yarn brake for a yarn feeding device. The braking body is held by a first spring assembly in its outer region in a ring-shaped carrying structure. The braking body is formed as a closed circular ring with the conical braking surface positioned adjacent to the inner diameter. The braking surface is continued by a plurality of outwardly extending lamellas having an arc curvature. The lamellas define the first spring assembly. The outer ends of the spring lamellas are interconnected by a ring element which can be mounted to the carrying structure. In a yarn feeding device equipped with the yarn brake, the carrying structure is supported in an universal joint such that it can tilt relative to the support to all sides.

21 Claims, 3 Drawing Sheets

YARN BRAKE AND YARN FEEDING DEVICE HAVING A YARN BRAKE

FIELD OF THE INVENTION

The invention relates to a yarn brake and to a yarn feeding device.

BACKGROUND OF THE INVENTION

In a yarn brake known from DE-U-94 06 102 which is to be mounted at a yarn feeding device, the braking body is a thin walled metallic ring band with the shape of a frustocone jacket the inner side of which forms a braking surface co-operating with the withdrawal rim of the storage drum. The braking body is supported at the outer edge region of the carrying structure by means of a frustoconical plastic foam ring having a rectangular cross-section. Said plastic foam ring is glued to the rear side of the braking body and into the annular carrying structure. The carrying structure is supported at the stationary support of the yarn feeding device by a group of axial coil springs located coaxially to the centre axis of the yarn brake. The foam material forms a first spring assembly and allows the braking surface to locally yield in the yarn passing region. The foam material also has to transfer axial load from the axial coil springs onto the braking surface. The carrying structure is rigid. The first spring assembly is acting substantially at the diameter of the braking surface. The necessary bondings or gluings are difficult to manufacture and tend to degrade during operation of the yarn brake. Furthermore, any gluing spots cause inhomogeneties which produce fluctuations of the yarn tension during the orbiting movement of the withdrawn yarn between the braking surface and the withdrawal rim. A correct centring of the braking body at the withdrawal rim also can not be achieved for operation conditions.

It is an object of the invention to provide a yarn brake of the kind as mentioned and a yarn feeding device with a yarn brake which is easy to manufacture and very reliable, at which the braking surface reliably remains centred and wherein the braking surface shows an extremely uniform deformation performance in the circumferential direction. At the yarn feeding device the yarn brake should lead to a braking effect which fluctuates as little as possible. Furthermore, the braking effect should be accompanied by a self compensation effect. This means that the tension in the withdrawn yarn increases as little as possible in case of increasing yarn speed or increasing yarn acceleration, respectively, such that the yarn tension only varies a little relative to a precisely adjustable basis tension. Finally, a large adjustment range should be achieved within which the braking effect can be adjusted gradually.

The above object is achieved by providing a yarn brake having an annular and thin-walled braking body with a circumferentially continuous conical braking surface. The braking body is mounted via a first spring assembly in an annular carrier structure arranged at a side of the braking body facing away from the braking surface, which carrier structure is mountable at a stationary support. The conical braking surface of the braking body is continued unitarily by a plurality of springy lamellas extending outwardly essentially in a star-like fashion. The lamellas are formed with a pre-shaped curvature and are interconnected at a radial distance from the braking surface by an outer ring element and the lamellas constitute the first spring assembly within said braking body.

The above object is also achieved by providing a yarn feeder having a yarn brake, the yarn feeder including a storage drum forming a frontal withdrawal rim which is continuous in the circumferential direction. The yarn feeder also includes a housing bracket with a stationary support for the yarn brake, and the yarn brake includes an annular, thin-walled radially deformable braking body with a circumferentially continuous conical braking surface. The braking body is mounted via a first spring assembly in an outer ring of a cup-shaped, hollow carrier structure supported at the stationary support so as to axially and yieldably press the braking surface against the withdrawal rim. The carrier structure is tiltably supported by a universal joint at the stationary support, the universal joint centre essentially coinciding with the centre axis of the storage drum, and the universal joint consists of two positively interengaging ring parts, one of which is defined by a seat ring of the carrier structure and the other is a ring-shaped counter-engagement element formed with a spherical bearing surface.

The yarn brake can be manufactured for fair costs and in a simple way, since the braking body having the integrated and pre-bent lamellas and the ring element interconnecting the outer ends of the lamellas and the annular braking surface can be prefabricated comfortably. No bondings or gluing spots are needed to manufacture the braking body or to fix the braking body in the carrying structure. The lamellas generate their spring effect between the inner and outer ring parts and in the circumferential direction uniformly and with a large effective lever arm. The axial pre-load is transferred into the braking body by the carrying structure which in turn is supported at the stationary support. A long-stroke elasticity range results as well as a very uniform deformation performance of the braking surface in the circumferential direction. A correct centring of the braking surface at the withdrawal rim also results. Thanks to the long-stroke of the spring assembly, the braking surface compensates for possible deviations of the roundness of the withdrawal rim. Since there is no foam materials or elastomeric materials and no bonding spots, spring properties and braking properties can be assured which remain constant for long operation durations and which are not influenced by ageing or degrading. Furthermore, it is assured that deviations from a precise circular shape of the withdrawal rim do not influence the yarn tension or the uniformity of the braking effect over a full revolution of the yarn withdrawal point, as such deviations are compensated for. A particular advantage of the structure of the braking body is a relatively flat spring rate which allows precise and gradual adjustment of the braking effect between an extremely weak braking effect and an extremely strong braking effect. This is due to the relatively long axial stroke between the braking surface positioned by the pre-bent lamellas in a predetermined orientation and the carrying structure. The positive effect results from the fact that the pre-bent lamellas distribute over a long adjustment stroke the adjustment range of the yarn brake.

The carrying structure is supported by the universal joint in the yarn feeding device such that it can tilt to all sides. Due to the form fit of the ring parts the universal joint leads to a reliable centring. The universal joint does not allow any uncontrolled relative lateral movements but an optimum tilted position of the carrying structure to compensate for misalignments between the support and the storage drum of the yarn feeding device. Such misalignments may result from the assembly or the manufacturing of the components. The braking body itself is an easily replaceable part.

Manufacturing is facilitated also when the outer ring element is a unitary part of the braking body. The braking body for example is made from a metal foil blank, e.g. by etching or laser cutting the interspaces between the lamellas before they undergo a plastic deformation into their curved configuration. By this measure a first spring assembly with a long stroke is integrated into the braking body. The first spring assembly additionally holds the braking surface in an orientation at the withdrawal rim needed for an optimum braking performance. Due to this measure, the braking surface need not be deformed by the axial pre-load out of a radial orientation which is particularly advantageous in case of a very weak braking effect, e.g. for very thin yarns.

Alternatively, the outer ends of the lamellas are imbedded in a plastic ring, preferably by injection moulding, such that the plastic ring becomes part of the braking body.

The braking body is seated with a form fit in a socket of the carrying structure and is detachably mounted in the socket by means of a securing ring. The securing ring, preferably made from plastic material, is only needed for transport or the assembly procedure to prevent detachment of the braking body. In the operational position of the yarn brake, the braking body is secured by the axial pre-load.

In order to achieve a very uniform deformation performance of the braking surface and a relatively soft braking body, the stretched length of each lamella ought to correspond to a multiple of the width of the braking surface. Small interspaces between adjacent lamellas prevent the yarn from being caught.

The lamellas are pre-bent almost or exactly to an essentially radial orientation, or even further. Their inner roofs continue along the generatrice of the conical braking surface. Expediently, the ring element of the braking body is positioned radially which simplifies the fixation of the braking body in the carrying structure. By the plastic pre-bending of the lamellas prior to assembly of the yarn brake, the long stroke of the soft integrated spring assembly can be predetermined upon demand.

A long adjustment stroke in connection with long effective lengths of the lamellas and a soft characteristic are achieved by several bends (snake line shape) in the lamellas.

In order to vary the softness of the first spring assembly or the effective length of the lamellas, in case of a given radial mounting space for the yarn brake the lamellas can be formed such that they deviate from a radial orientation.

An advantageous axial pre-load transfer principle is selected in view of the desired self-centring of the yarn brake and a desirable "lazy" operation performance of the braking surface. In the kinematical chain of the force transmission from the support into the braking surface, the force is acting within an axial long stroke of the elasticity range of the yarn brake from relatively far inward first outwardly into the ring element of the braking body, and then from the outer side by means of the lamellas again inwardly into the braking surface. That long force transmitting path is of advantage for the elasticity and is achieved by the structure of the yarn brake even if the useable mounting space for the yarn brake is limited in radial and axial directions.

Of particular advantage are spokes connecting the outer ring with the seat ring of the carrying structure. They form bending spring arms defining an additional large stroke and soft spring assembly in the yarn brake. These two spring assemblies acting in series within the yarn brake lead, e.g. to an adjustment range of extreme magnitude, a good self-centring function, an optimum compensation of misalignments, and an extreme de-coupling of the braking surface which behaves very passively or "dead" in operation, i.e. the braking surface does not act undesirably dynamically. This is particularly important for high yarn speeds. Expediently, the spring rates of the first and second spring assemblies are substantially similar such that both spring assemblies do work during operation. The large stroke of the adjustment range is particularly expedient to gradually adjust the braking effect. In the lateral and torsional directions the carrying structure, however, is relatively stiff. The carrying structure is relatively soft only in the axial and tilting directions.

Advantageously, leaf springs are provided as spokes of the carrying structure, e.g. eight leaf springs are provided in a flat orientation. The number of lamellas in the braking body can amount to 200 or more in order to achieve a uniform force transmission.

Special dimensional relations for the leaf springs are advantageous. The yarn brake then operates softly over a long stroke. The braking surface shows a very uniform deformation performance. Said advantages result from both spring assemblies acting in series and from the long force transmission path from far inwards to the outer region and back into the inner region.

In order to achieve a uniform braking effect in the circumferential direction it is of advantage when the seat ring of the carrying structure is a component of the universal joint which defines the universal joint in co-action with a stationary counter engagement element. By said universal joint the yarn brake is properly centred in a form fit. There is a large degree of freedom for tilting motions to all sides in order to compensate for occasionally existing manufacturing or mounting tolerances between the stationary support and the storage drum.

The main components of the yarn brake are prefabricated components which then are releasably assembled without bonding spots.

In the yarn feeding device, the yarn brake produces only very small fluctuations of the yarn tension in relation to a pre-adjusted basis yarn tension of the withdrawn yarns. The yarn brake operates with an efficient self-compensating effect, meaning that high yarn speeds or strong yarn accelerations do not cause a significant increase of the yarn tension. To the contrary, in operation an optimum yarn tension profile can be achieved which shows almost no fluctuations. The variability of the braking effect departing from a very weak braking effect is distributed over a long adjustment stroke. The basis tension braking effect can be adjusted precisely.

The full extent of the available mounting space between the storage drum and bracket of the yarn feeding device can be used for the force transmission and the wide range elasticity of the yarn brake. Despite the yarn brake mounted therein, the access to the storage drum and to the area between the storage drum and the withdrawal eyelet is hardly restricted.

BRIEF DESCRIPTION OF THE DRAWINGS

Embodiments of the invention will be described with reference to the drawings, in which.

DETAILED DESCRIPTION

Figure 1:
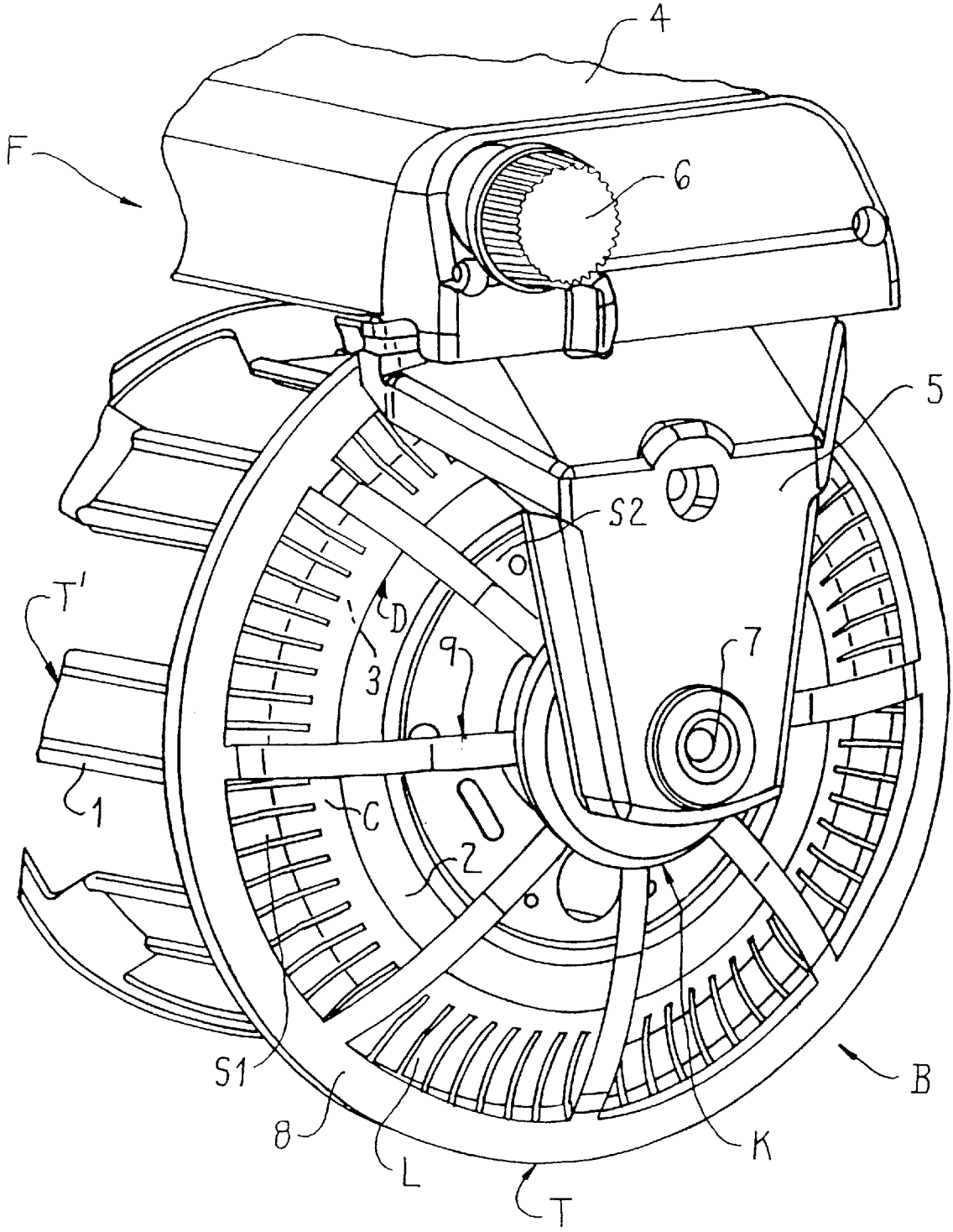
FIG. 1 is a perspective partial view of a yarn feeding device having a yarn brake.

FIG. 1 shows a front of a yarn feeding device F. Said yarn feeding device F is intended to feed a weft yarn to a weaving machine. The yarn feeding device F comprises a stationary storage drum T' defining a storing surface 1 which extends via a rounded withdrawal rim 3 into a front side 2 of said storage drum T'. Withdrawal rim 3 is circumferentially continuous and circular. From the housing (not shown) of the feeding device F a stationary bracket 4 protrudes along the side of storage drum T'. Said bracket 4 extends beyond the region of front side 2. Bracket 4 carries an arm 5 the axis portion of which can be adjusted along bracket 4 by an adjustment device 6. Arm 5 carries a withdrawal eyelet 7 situated coaxial to the storage drum T' for the yarn withdrawn by the weaving machine. Furthermore, said arm 5 forms a stationary support A for a yarn brake B. The task of said yarn brake B is to brake or tension the withdrawn yarn by a braking effect which should be as uniform as possible. The yarn is stored in adjacent windings on storage surface 1 and is withdrawn axially over the withdrawal rim 3 and further through withdrawal eyelet 7. During withdrawal the tensioned weft yarn is orbiting around withdrawal rim 3 like the hand of a clock.

The yarn brake B is operating with a self compensation effect. This means that the braking effect of the yarn brake as adjusted to a predetermined tension adapted to the yarn speed or yarn acceleration such that an essentially constant tension profile is maintained in the withdrawn yarn irrespective of whether the yarn is withdrawn slowly or rapidly or with strong or weak acceleration. The yarn brake B has a flat conical circumferentially continuous braking surface C defined by a thin braking body D supported at support A by a carrying structure T such that the braking surface C is pressed with an adjustable axial contact force against withdrawal rim 3. Said braking surface cannot be stretched in the circumferential direction but is softly deformable perpendicular to its surface. The braking surface is deformed by the yarn into a wave circulating with the rotating withdrawal point of the yarn.

The braking body D is a circular and closed ring made from a metal foil, e.g. from a beryllium-copper alloy, of small wall thickness, e.g. 0.1 mm to 0.8 mm. The ring-shaped braking surface C is continued in a star-like manner by lamellas L extending outwardly to a closed ring element R. By said ring element R the braking body D is held in an outer edge region or outer ring 8 of said carrying structure T. Spokes 9 extend from outer ring 8 of said carrying structure to a seat ring 10. Seat ring 10 co-operates with a counter engaging element 11 formed as a ring element of support A to define a structure similar to a universal joint or ball joint, the joint centre of which is positioned essentially on a prolongation of the axis of the storage drum T'.

The lamellas L are deformed plastically such that they have an arc curvature the concave side of which faces the carrying structure T. Said lamellas L define bending springs all of which form a first braking body spring assembly S1. The spokes 9 also are curved bending spring arms and define a second carrying structure spring assembly S2.

Alternatively the carrying structure T could be defined by said outer rings only directly supported in a ring-shaped support (not shown) at bracket 4.

Figure 2:
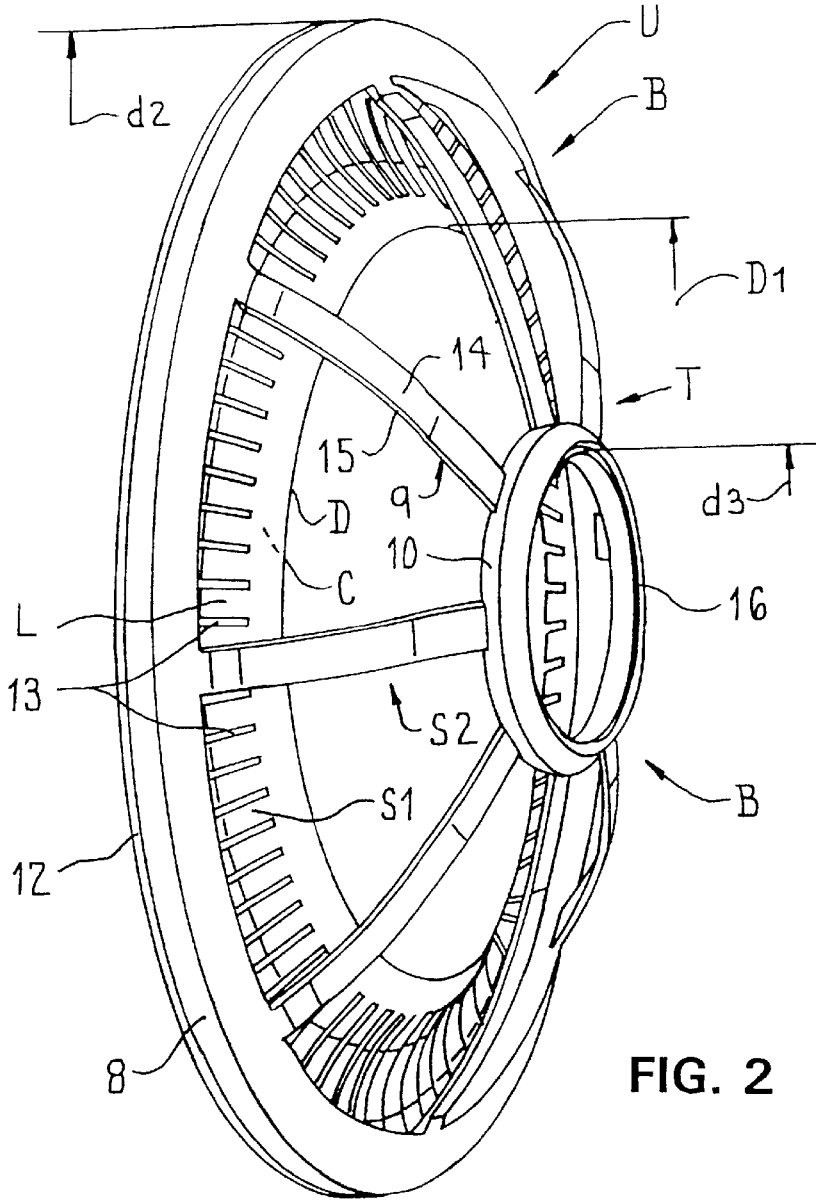
FIG. 2 is a perspective view of the yarn brake itself.

Yarn brake B in FIG. 2 defines a structural unit U for easy insertion into the yarn feeding device F, e.g. of FIG. 1. It can be replaced any time. Support A transmits an axial preload onto the conical, circumferential continuous braking surface C of braking body D. Support A is effective on a diameter d3 significantly smaller than the inner diameter d1 of braking surface C. Between braking surface C and support A a considerable axial distance is provided. The force transmission path begins inside, and first extrudes outwardly via the second spring assembly S2. The spokes 9 in said second spring assembly S2 expediently have an arcuate curvature with the concave sides 15 facing braking body D. Advantageously said spokes 9 (radial spokes) are defined by leaf springs 14 the ends of which are firmly anchored at seat ring 10 and at outer ring 8. Between both ends the spokes follow a harmonic arc curvature. By said shape the outer ring 8 is allowed to axially yield relative to seat ring 10 and also can tilt. In the shown embodiment eight spokes 9 are provided. The number of spokes may be bigger or smaller. Said radial spokes 9 are disposed at regular circumferential distances from one another. The thickness of the leaf springs 14 may be between 0.1 mm and 1.0 mm. Their width amounts to about 3 mm to 10 mm, preferably to about 4 mm to 5 mm. The leaf springs may be made from steel (spring steel) or from plastic or compound material. The thickness or the width of the leaf springs may even vary along their longitudinal extension in order to achieve a special predetermined spring behavior.

Outer ring 8 has a significantly bigger diameter d2 than inner diameter d1 of braking surface C, e.g. diameter d2 can amount to about 180% of d1 while diameter d3 is about 40% of d1. Outer ring 8 is made form stable. It transmits the force via the braking body D or the lamellas L, respectively, inwardly into the braking surface C. The longitudinal extension of the spring-lamellas L is a multiple of the width of the conical braking surface C.

Figures 5A, 5B, 5C:
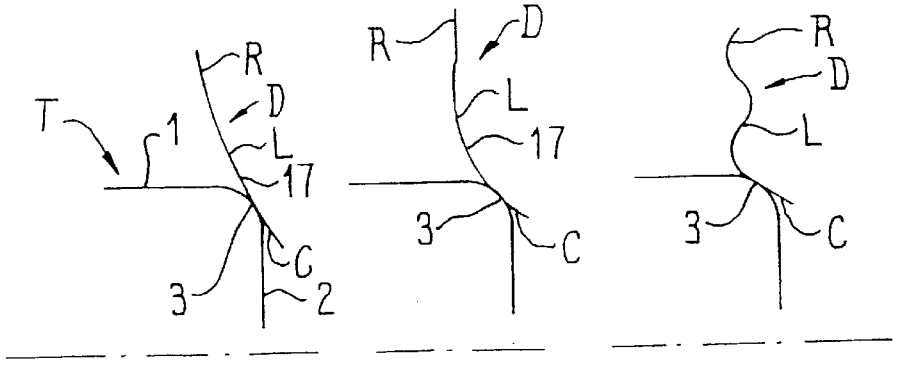
FIGS. 5A, 5B and 5C schematically show three curvature shapes of the lamellas of the braking body of the yarn brake.

In a concise embodiment of braking body D more than 200 lamellas L are provided. Between said spring-lamellas L narrow interspaces 13 (width of about 0.1 mm to 0.3 mm) are formed. Since said interspaces 13 do have essentially constant widths the widths of the lamellas L increase from the braking surface C outwardly. The thickness of the braking body e.g. formed from a circular ring-shaped, closed metal foil blank, e.g. from beryllium-copper, can be e.g. between 0.1 mm and 0.8 mm. Interspaces 13 can be formed by etching or laser cutting. The arc curvature of the lamellas L e.g. is made under the influence of pressure and temperature in a mould and by plastic deformation such that braking surface C maintains a circumferentially uniform cone angle even without axial pre-load of the yarn brake. The lamellas L extending outwardly from the braking surface C first follow at their inner roots the direction of the generatrice of the cone surface of the braking surface C and then deviate gradually outwardly such that their ends have an essentially radial orientation (almost radial, radial or even overbent or bent like a snake or serpentine according to FIGS. 5A, 5B, 5C).

FIG. 2 shows a securing ring 12 holding braking body D in carrying structure T. Said securing ring 12 removably engages into outer ring 8 and clamps the outer edge region of the braking body D in position. Ring 12 may be snapped in place.

Seat ring 10 can be formed with a seat surface 16 for co-operation with a counter engaging element not shown in FIG. 2 for the optionally desired universal joint or ball joint function at the support A (FIG. 1).

Figure 3:
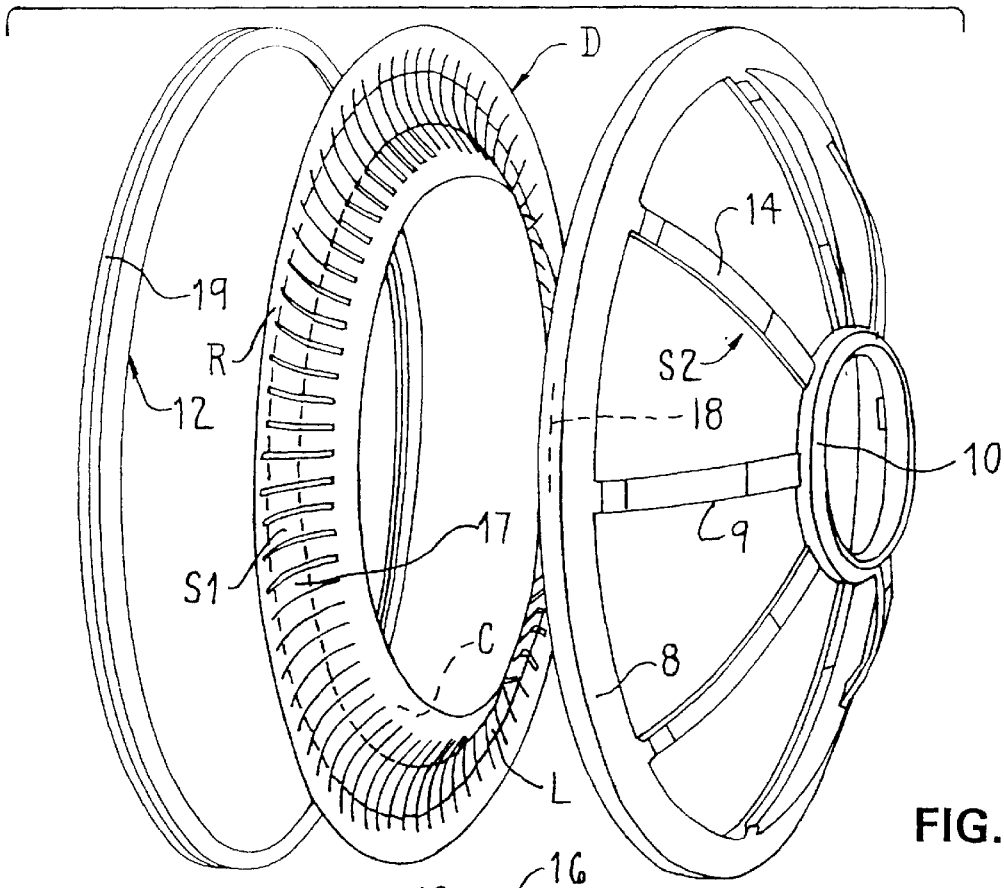
FIG. 3 is an exploded view of the yarn brake.

FIG. 3 shows the three components T, D, 12, in an exploded view. The radial spokes 9 form the second spring assembly S2 in carrying structure T consisting of outer ring 8, spokes 9 and seat ring 10. Outer ring 8 is yieldably supported by the second spring assembly S2 such that it may yield axially and may tilt relative to seat ring 10. A ring socket 18 (indicated in dotted lines) can be formed in outer ring 8 serving to hold the braking body D and optionally also securing ring 12 to replaceably seat the braking body. The spring characteristics of spring assemblies S1, S2 should be similar or almost equal.

Lamellas L in FIG. 3 continue the braking surface C outwardly in a star-shaped fashion. Their concave side 17 is oriented towards the carrying structure T. The outer ends of said lamellas L are unitarily connected in a ring element R which is concentric to braking surface C. Said ring element R is secured in socket 18 of outer ring 8 by securing ring 12 which may have protrusions or a circumferential snap flange 19 to achieve a snap-in function. The radial width of securing ring 12 corresponds broadly to the radial width of ring element R. Ring element R is positioned essentially in a radial plane of braking body D. Alternatively ring element R could be made conical.

Braking body D may be formed from a metal or plastic foil with freely ending lamellas L. Then the outer ends of said lamellas could be interconnected by an injection moulded plastic ring (similar to securing ring 12). Said plastic ring then could form both ring element R of FIG. 3 and securing ring 12 of FIG. 3 of holding body D in carrying structure T.

In a concise embodiment the braking body D has an outer diameter of about 180 mm. Diameter d1 amounts to about 150 mm. The blank for braking body D has a radial width of about 40 mm. Seat ring 10 has an inner diameter d3 of about 45 mm. Its axial distance from outer ring 8 is about 40 mm. Thanks to the arc curvature of lamellas L the braking surface C is situated in the interior of carrying structure T such that its biggest diameter coincides substantially with the rear contour of outer ring 8 (in a side view) and as long as the yarn brake B is not inserted into the yarn feeding device. The spring rate of the first spring assembly S1 formed by said lamellas is substantially equal to the spring rate of the second spring assembly S2.

Figure 4:
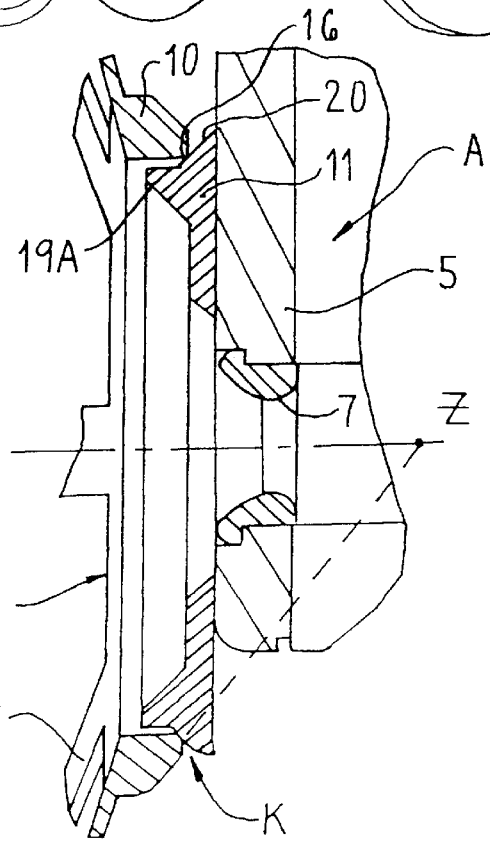
FIG. 4 is an axial sectional view of the support area of the yarn brake in the yarn feeding device.

FIG. 4 shows the universal joint or ball joint K at support A. In said joint K the yarn brake B may tilt about the centre axis of the storage drum T or the centre axis of the yarn brake B, respectively, in order to self-centre properly at withdrawal rim 3. Seat ring 10 of carrying structure T is seated by its bearing surface 16 at an e.g. spherical bearing surface 20 of counter engaging element 11. Counter engaging element 11 is positioned at arm 5 and concentrically surrounds withdrawal eyelet 7. Bearing surface 20 is limited at its inner side by a ring flange 19A which is acting as a tilt limit for carrying structure T.

Said ball joint K is of advantage to improve the self-centring of the yarn brake B at the withdrawal rim 3 of storage drum T. Due to the given flexibility or softness achieved in the yarn brake by the first and second spring assemblies S1 and S2 arranged in series, alternatively seat ring 10 could be supported firmly at arm 5, i.e. without the universal joint function. Securing ring 12 as a third component of yarn brake B could be eliminated, provided that braking body B is directly integrated into carrying structure T, e.g. by injection moulding of outer ring 8 around ring element R or over the free ends of the bending spring lamellas L. In this case also the carrying structure T has to be replaced when the braking surface C is worn or the braking body D is to be replaced.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A yarn brake for a yarn feeder comprising an annular and thin-walled braking body having a circumferentially continuous and conical braking surface, said braking body being mounted by a spring assembly in an annular carrier structure arranged at a side of said braking body facing away from said braking surface and mountable at a stationary support, said braking surface of said braking body being continued unitarily by a plurality of springy lamellas extending outwardly essentially in a star-like manner, said lamellas being formed, in a radial section of said braking body, with a predefined arc-shaped curvature and being interconnected at a radial distance from said braking surface by an outer ring element, said lamellas defining said spring assembly within said braking body.

2. The yarn brake of claim 1, wherein said outer ring element is formed unitarily with said lamellas.

3. The yarn brake of claim 1, wherein said outer ring element is constructed of plastic or metal material and is connected to outer ends of the respective lamellas.

4. The yarn brake of claim 1, wherein said braking body is formed from an annular metal foil blank in which said arc-shaped curvature of said lamellas is achieved by bending said lamellas through plastic deformation by application of temperature and/or pressure.

5. The yarn brake of claim 1, wherein said carrier structure comprises an outer ring which defines a round socket therein, said outer ring element being detachably mounted in said socket by means of a plastic and/or metallic securing ring.

6. The yarn brake of claim 1, wherein a stretched length of each of said lamellas corresponds to four to eight times a width of said braking surface, a circumferential width of each said lamella being between about 0.5 mm and about 1.5 mm, and a space is provided between each pair of adjacent lamellas, each said space having a width between about 0.1 mm and about 0.5 mm.

7. The yarn brake of claim 1, wherein each lamella extends outwardly from said braking surface first in a direction of a cone generatrice thereof and then gradually bends so as to have an essentially radial orientation, and said outer ring element is disposed in a radial plane of said braking body.

8. The yarn brake of claim 1, wherein each said lamella defines therein several snake-like bends between said braking surface and said outer ring element.

9. The yarn brake of claim 1, wherein said carrier structure includes an outer ring, an inner seat ring which is axially spaced from a plane of said outer ring, said inner seat ring having a substantially smaller diameter than said outer ring, and a plurality of uniformly distributed and radially oriented spokes which interconnect said outer ring and said inner seat ring.

10. The yarn brake of claim 9, wherein said spokes are designed as bending spring arms to resiliently connect said outer ring with said inner seat ring in an axially movable and tiltable manner, said spring assembly being a first spring assembly and said bending spring arms define in said yarn brake a second spring assembly integrated into said carrier structure, an axial spring property of said second spring assembly being substantially the same as an axial spring property of said first spring assembly, and said second spring assembly being substantially stiff in lateral and torsional directions.

11. The yarn brake of claim 10 wherein said bending spring arms comprise leaf springs mounted in a bent condition between said outer ring and said inner seat ring, and opposite ends of each said leaf spring are rigidly connected to said outer ring and said inner seat ring, respectively.

12. The yarn brake of claim 11, wherein said leaf springs each have a thickness of about 0.1 mm to about 1.0 mm and a width of about 4.0 mm to about 10.0 mm.

13. The yarn brake of claim 12, wherein said leaf springs each of a width of about 5.0 mm.

14. The yarn brake of claim 9, wherein said inner seat ring has an inner diameter which is smaller than an inner diameter of said braking surface, and said outer ring has a diameter larger than said inner diameter of said braking surface.

15. The yarn brake of claim 14, wherein said inner diameter of said inner seat ring is about 40% smaller than said inner diameter of said braking surface, and said diameter of said outer ring is about 160% larger than said inner diameter of said braking surface.

16. The yarn brake of claim 9 wherein said inner seat ring and a stationary counter-engagement element of said stationary support of the yarn feeder together define a ball joint, said ball joint permitting tilting of said yarn brake about an axis of a storage drum of a yarn feeder.

17. The yarn brake of claim 1 wherein said braking body and said carrier structure are detachably positively connected to one another without bonding areas.

18. The yarn brake of claim 1, wherein said braking body has an inner diameter portion which defines said braking surface thereon, said lamellas have respective inner ends which are connected to said inner diameter portion and outer ends opposite the respective inner ends which are connected to said outer ring element which defines an outer diameter portion of said braking body radially and axially spaced from said inner diameter portion, said lamellas being circumferentially spaced from one another at regular intervals about the circumference of said braking body, and each adjacent pair of said lamellas defining therebetween a space which extends radially outwardly from said inner diameter portion.

19. The yarn brake of claim 18, wherein said carrier structure includes an outer mounting ring and an inner ring axially spaced therefrom, said inner ring having a smaller diameter than said outer mounting ring and being concentric therewith, and a plurality of spring arms having respective inner ends connected to said inner ring and outer ends opposite the respective inner ends which are connected to said outer mounting ring, said spring arms being circumferentially spaced from one another at regular intervals about the circumference of said carrier structure, said outer mounting ring defining therein an annular opening in which said outer diameter portion of said braking body is detachably mounted to secure said braking body within said carrier structure.

20. A yarn feeder having a yarn brake, said yarn feeder comprising a stationary storage drum defining a frontwardly oriented withdrawal rim which is continuous in a circumferential direction, a housing bracket including a stationary support for said yarn brake, said yarn brake comprising a braking body with a circumferentially continuous conical braking surface, said braking body being mounted by a first spring assembly in an outer ring of a cup-shaped and hollow carrier structure supported at said stationary support to axially and yieldably press said braking surface against said withdrawal rim, said braking body comprising an annular, thin-walled, radially deformable and closed circular ring constructed of a metal foil and defining said braking surface thereon which borders an inner diameter of said braking body, said braking body including a plurality of elastic lamellas which are unitary with said braking surface and continue said braking surface outwardly in a star-like manner, said lamellas defining said first spring assembly of said yarn brake and being interconnected at a radial distance from said braking surface by a ring element mounted to said carrier structure, said lamellas having a predefined arc-shaped curvature, as viewed in a radial section of said braking body, facing an inner side of said carrier structure, said carrier structure being supported so as to be sidewardly tiltable through a ball joint disposed at said stationary support and having a joint center which essentially coincides with a center axis of said storage drum, said ball joint including two positively interengaging ring parts, one of which is defined by an inner seat ring of said carrier structure and the other of which is a ring-shaped counter-engagement element defining thereon a spherical bearing surface which engages with said inner seat ring, said carrier structure including spokes which connect said outer ring and said inner seat ring and together comprise a second spring assembly of said yarn brake, said braking body being held in said carrier structure a substantial radial distance from said braking surface, and said inner seat ring being supported at said stationary support a substantial radial distance inwardly of said braking surface and at an axial distance from said braking surface.

21. The yarn feeder of claim 20, wherein said counter-engagement element surrounds a withdrawal eyelet of said yarn feeder and is mounted on an arm which is axially displaceable relative to said housing bracket.

* * * * *